US009378616B2

(12) United States Patent
Kleppen et al.

(10) Patent No.: US 9,378,616 B2
(45) Date of Patent: Jun. 28, 2016

(54) DEVICE SECURITY IN A GAMING MACHINE

(71) Applicant: IGT, Reno, NV (US)

(72) Inventors: Dennis T. Kleppen, Henderson, NV (US); Dwayne R. Nelson, Las Vegas, NV (US)

(73) Assignee: IGT, Reno, NV (US)

( * ) Notice: Subject to any disclaimer, the term of this patent is extended or adjusted under 35 U.S.C. 154(b) by 458 days.

(21) Appl. No.: 13/788,667

(22) Filed: Mar. 7, 2013

(65) Prior Publication Data

US 2014/0256418 A1 Sep. 11, 2014

(51) Int. Cl.
*G07F 17/32* (2006.01)

(52) U.S. Cl.
CPC ..... *G07F 17/3241* (2013.01); *G07F 17/32* (2013.01)

(58) Field of Classification Search
CPC . G07F 17/3241; G07F 17/3255; A63F 13/70; A63F 13/71; A63F 13/77; A63F 2300/401; A63F 2300/5546
USPC ..... 463/29, 42
See application file for complete search history.

(56) References Cited

U.S. PATENT DOCUMENTS

2007/0174909 A1* 7/2007 Burchett et al. ..... 726/18
2009/0013055 A1* 1/2009 Hall et al. ..... 709/208

* cited by examiner

*Primary Examiner* — James S McClellan
(74) *Attorney, Agent, or Firm* — Griffiths & Seaton PLLC

(57) ABSTRACT

A gaming system employs a device security firewall having a plurality of rules and an inclusion list of a plurality of devices allowed to operate on a gaming device for determining acceptable data traffic on the gaming device.

33 Claims, 7 Drawing Sheets

700

| ENTRY | NAME | MANUFACTURER | PRODUCT | VERSION |
|---|---|---|---|---|
| 1 | TICKETS USA TICKET PRINTER | 0X6217 (TICKETS USA) | 0X1458 | 1.01A |
| 2 | MEI BILL ACCEPTOR | 0X8823 (MEI) | 0X6675 | 2.02 |
| 3 | SONY TOUCHSCREEN | 0X1155 (SONY) | 0X7778 | 1.54 |
| 4 | RAINBOW EKEY | 0X9876 (RAINBOW) | 0X7620 | 1.0 |

FIG. 7

DEVICE SECURITY IN A GAMING MACHINE

COPYRIGHT NOTICE

A portion of the disclosure of this patent document contains or may contain material, which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

1. Field of the Invention

The present invention is related in general to gaming devices and systems, and more particularly to device security in a gaming system.

2. Description of the Related Art

Games of chance have been enjoyed by people for many years and have undergone increased and widespread popularity in recent times. As with most forms of entertainment, some players enjoy playing a single favorite game, while others prefer playing a wide variety of games. In response to the diverse range of player preferences, gaming establishments commonly offer many types of electronic games. Many electronic gaming machines (EGMs), such as slot machines and video poker machines, have been a cornerstone of the gaming industry for several years. The EGMs are computer based and contain multiple external interfaces for connecting with external devices. As such, these external devices present increased security risks via malicious, untested, and/or non-regulatory approved external devices compromising the gaming integrity of the EGMs.

SUMMARY OF THE DESCRIBED EMBODIMENTS

A current challenge for gaming institutions, in view of increasingly popular use by players, and an increasing number of electronic gaming machines and the like in gaming environments, is advantageously providing the EGMs, especially microprocessor-based gaming machines that store gaming programs for operating and using the EGM, with the flexibility and capabilities of communicating with external devices. Given the vast number of external devices, along with many operating software systems capable of supporting both tested and untested external devices, a need exists to substantially minimize, if not totally eliminate, the possibility of unauthorized control or modification of software used by EGMs, and allow only tested and regulatory approved electronic devices to communicate with the EGM.

To address these aforementioned needs, in one embodiment, by way of example only, a method is provided for a device security system in a gaming system. The gaming system employs a device security firewall having defined rules and an inclusion list of devices allowed to operate on a gaming device and an exclusion list of devices not allowed to operate on the gaming device for determining acceptable data traffic on the gaming device. In addition to the foregoing exemplary method embodiment, other exemplary system and computer product embodiments are provided and supply related advantages.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which:

FIG. 7 is a diagram illustrating an inclusion list in which aspects of the present invention may be realized.

DETAILED DESCRIPTION OF THE DRAWINGS

Figure 1:
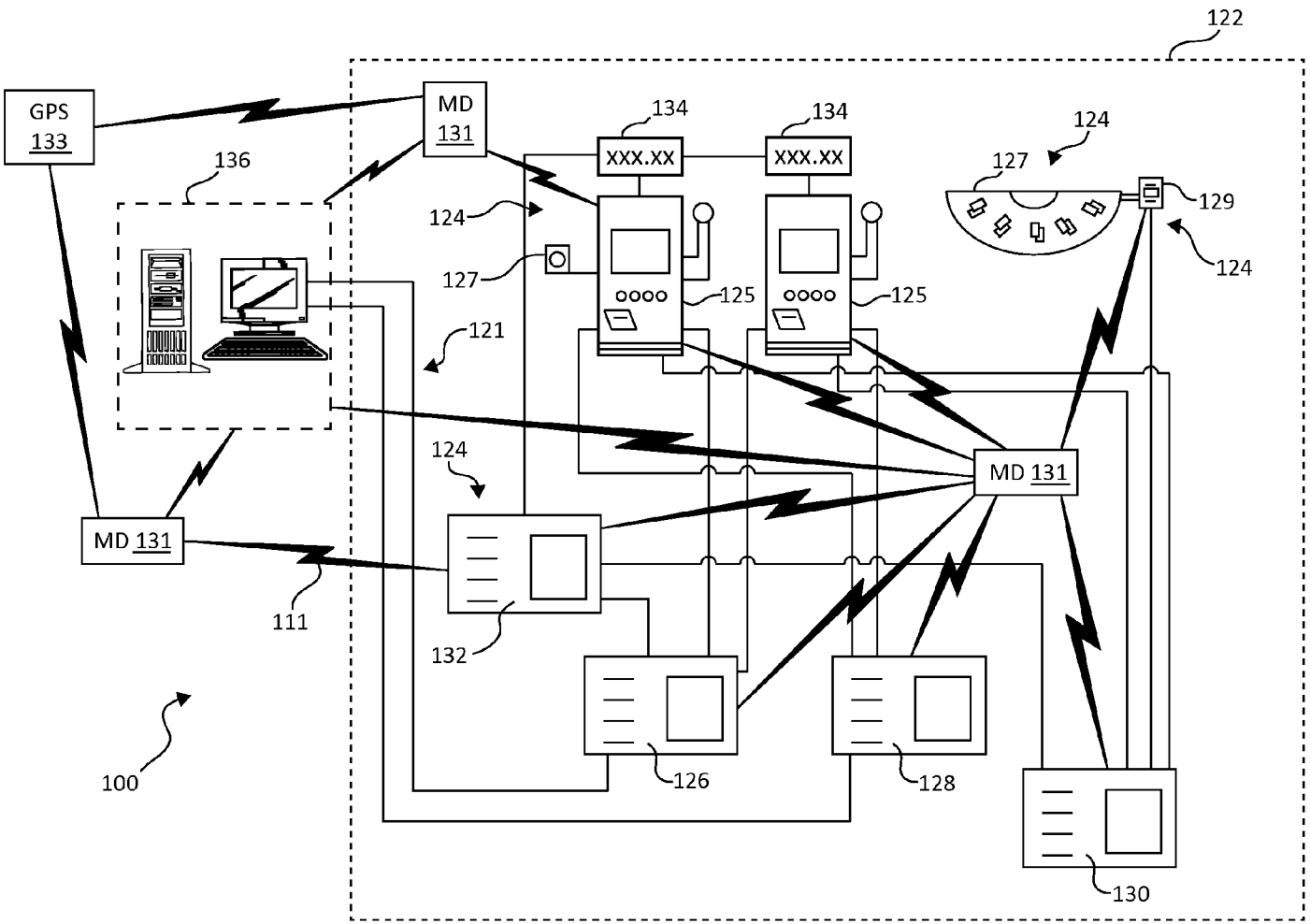
FIG. 1 is a block diagram illustrating a gaming system environment with a gaming terminal data repository (GTDR) connected via one or more network interface(s) to a gaming network which, for example, may include gaming devices (e.g., gaming terminals), in which aspects of the present invention may be realized.

In general, gaming machines require a player to place or make a wager to activate a primary or base game. The award may be based on the player obtaining a winning symbol or symbol combination and on the amount of the wager (e.g., the higher the wager, the higher the award). Symbols or symbol combinations that are less likely to occur usually provide higher awards. In such gaming machines, the amount of the wager made on the base game by the player may vary. For instance, a gaming machine may allow the player to wager a minimum number of credits, such as one credit (e.g., one penny, nickel, dime, quarter or dollar) up to a maximum number of credits, such as five credits. The player may make this wager a single time or multiple times in a single play of a primary game. For instance, a slot game may have one or more pay lines and the slot game may allow the player to make a wager on each pay line in a single play of the primary game. Slot games with 1, 3, 5, 9, 15 and 25 lines may be provided. Thus, a gaming device, such as a slot game, may allow players to make wagers of substantially different amounts on each play of the primary or base game ranging, for example, from one credit up to 125 credits (e.g., five credits on each of 25 separate pay lines). This is also true for other wagering games, such as video draw poker, where players can wager one or more credits on each hand and where multiple hands can be played simultaneously. Different players play at substantially different wagering amounts or levels and at substantially different rates of play.

The ever-increasing efficiency and sophistication of the electronic gaming machines (EGMs), especially microprocessor-based gaming machines that store gaming programs for operating and using the EGMs, with the flexibility and capabilities of communicating with external devices. The EGM devices have multiple external interfaces for connecting with external devices using standard communication protocols and data transfer interfaces, such as a universal serial bus (USB), Firewire, Thunderbolt, eSATA, and the like. Modern operating systems (OS), such as Microsoft® Windows® 7, within the EGMs have the ability to recognize many of the various external devices. Furthermore, the OS of the EGMs may support devices generically such that one device driver may support devices from multiple vendors. This presents a challenge to security of the EGMs since the OS may accept data traffic from a numerous amount of external devices, while only a subset of these external devices have been tested for security and achieving regulatory approval with the gaming machine. Of even more concern is the fact that a malicious, external device may be created to exploit the EGM's OS drivers.

Thus, in one embodiment, the illustrated embodiments described herein provide an inclusion list in the EGMs that contain approved, tested and accepted external devices. This assures that only tested and regulatory approved external devices are used in the gaming machine. In one embodiment, by way of example only, a gaming system employs a device security firewall having both a variety of different types of rules (e.g., regulatory rules and compliance requirements) and the inclusion list, which indicates the external devices allowed to operate on a gaming device, for determining acceptable data traffic on the gaming device. In so doing, the present invention eliminates and/or substantially minimizes the possibility of unauthorized control or modification of software used by EGMs, and allows only tested and regulatory approved electronic devices to communicate with the EGM.

To further illustrate the solution provided herein, consider the following examples. Consider an EGM that is running Windows® 7 or other type of operating system (OS). The EGM's OS may interact and work with external devices, such as a USB ticket printer, USB bill acceptor, and a USB touch screen and the like. In this scenario, the EGM is tested with the external devices of Ticket Printer 1 from Vendor 1, Bill Acceptor 2 from Vendor 2, and Touch Screen 3 from Vendor 3. The EGM gains regulatory approval for the EGM's hardware including these external devices. The EGM also gains regulatory approval for the EGM's own operating software (OS) that operates with these external devices. Since the EGM is using Windows® 7, the EGM may leverage the fact that the Windows® OS supports other USB devices such as hard drives, network adapters, audio devices, video devices, etc. However, in this example, these external devices have not been tested with the EGM's own software, nor have any received regulatory approval. To further complicate the problem, consider that Windows® 7 OS, or other type of OS, may have a large library of external devices that the OS supports thereby making it impossible to determine the full list of external devices that could be plugged into and operated by the EGM. Another complication is that a single category of external devices may include a long list of vendors. For example Windows® 7 OS may have one or more generic software drivers that accept external devices from multiple vendors. Those multiple vendors in turn could manufacture multiple versions of those external devices. In short, it becomes impossible to know all of the external devices that may effectively work in the EGM.

The concern over inserting these unknown devices is how the external device affects regulatory approval, overall quality, servicing capabilities and security of the EGM. For example, some external devices may not been reviewed by a regulatory body. Next, EGM manufacturers, such as IGT®, may not have tested the external devices causing the EGM to fail or operate in unacceptable methods. There may be variations in the behaviors of the external devices that may cause servicing concerns. And finally, a malicious attacker could make a modified version of these devices to attack the OS and gain control over the EGM software/hardware.

Considering further the malicious attacker scenario, a malicious attacker may learn of a deficiency in a particular type of OS, such as Windows® 7 OS, for a particular external device. For example, the attacker learns that the Windows® 7 operating system can be confused by a malformed USB packet in a particular network device command. This command is then used by a USB Ethernet adaptor. The malicious attacker makes a small USB device that reports to be this network device. The malicious device is then inserted into a USB port of the EGM. The OS (e.g., Windows® 7) accepts the device since it has the USB network device support. The device then goes on to invoke the known vulnerability by sending the malformed command over the USB to the OS and then gains access to the OS and EGM thereby exploiting the computer bug/virus.

As such, the illustrated embodiments described herein, provide a solution by introducing a device security firewall. In one embodiment, the device security firewall is maintained between the EGM and the OS. This device security firewall works in addition to a network firewall, and consists of defined rules (and/or regulations) for determining and controlling which type of data traffic from an external device is acceptable (e.g., acceptable in the gaming industry). The device security firewall has an inclusion list (e.g. a white list) of external devices allowed to operate in the EGMs. The white list, or inclusion list, contains specific information and characteristics about the external devices such as the manufacturer identification (ID), product ID, product version, product name, and the like. Some external devices may have sub-IDs for information that is also described in the white list. In one embodiment, the external devices listed on the inclusion list have been tested and are regulatory approved external devices for use in a EGM thereby ensuring the EGM's regulatory approval, overall quality, servicing capabilities and security of the EGM. Also, as each gaming venue may be located in different jurisdictions, the regulatory gaming commission rules, laws, and regulations may vary and alter accordingly. Thus, in one embodiment, the device security firewall may be provided a variety of the regulatory gaming commission rules, laws, and regulations in a regulatory gaming commissions rules list to work in conjunction with the inclusion list, and or be included in the inclusion list, for determining and controlling which type of data traffic from an external device is acceptable (e.g., acceptable in the gaming industry). For example, biometric data may be allowed in one gaming venue jurisdiction and thus the regulatory gaming commissions rules list, which may be part of the inclusion list, allows for the device security firewall to determine and control which type of data traffic to accept from an external device.

In one embodiment, the device security firewall is configured to only accept these external devices as described on the white list, or inclusion list. In one embodiment, the device security firewall defines the rules for accepting only the exact device listed on the inclusion list. In one embodiment, the device security firewall may be configured to accept all external devices produced by a specified manufacturer regardless of the version. The information for this inclusion list may be stored with the EGM, for example in an EGM software package. The inclusion list may also be stored in the persistent storage of the EGM so that the inclusion list is known even after power cycling the EGM. For example, the persistent storage may be non-volatile random access memory (NVRAM), E2, Flash memory, hard disk drive (HDD), solid state drive (SSD) and the like. Moreover, the inclusion list and the exclusion list may be both in a software package and in the persistent storage. For example, extending the inclusion list of allowed devices and the exclusion list of non-allowed devices in persistent storage enables the device security firewall to account for devices that were previously unknown when the software package was created, but that were later approved. In this manner, the need recreate the software package is eliminated, which re-creation triggers regulatory submission costs, and may require a reinstall on an EGMs just to, for example, allow a new coin acceptor model. The inclusion list and the exclusion list in the software package is digitally signed during manufacturing as part of the software package and cannot be changed in the field, but updates in persistent storage may be used to extend or correct issues in the laws, rules, and/or regulations stored in the software package.

In addition, there is a need to continuously update the list since manufactures of external devices release new version of products or replace products entirely, and also since the regulatory gaming commission rules, laws, and regulations may alter, change, and/or vary. The inclusion list and exclusion list may be updated in real time with updated product version, new or replacement external devices, new or different vendors and manufactures and the like. The inclusion list and exclusion list may be updated in real time with the regulatory gaming commission rules, laws, and regulations. For example, an EGM manufacturer, such as IGT®, could switch vendors thereby requiring the inclusion list and exclusion list to be updated. Moreover, a regulatory gaming commission may disqualify a particular manufacturer and/or device thereby prohibiting data traffic from this device. As such, the device security firewall would screen any data from the prohibited device. The white list, or a portion of the white list, may be entered in an operator screen located on a host device in the gaming network, on an EGM, and/or on an external device in communication with the gaming network. The operator screen may be configured to allow an operator, or technician of the EGM, to enter new ID's for the external devices that are added to the inclusion list and the exclusion list. The entire portion of the inclusion list and the exclusion list and/or only a portion of the inclusion list and the exclusion list may be displayed via the operator screen on the gaming device. In one embodiment the operator may be allowed to enter or update the characteristics and information for a new or existing external devices and may define the rules for each external device (e.g. a defined rule that only allows the device secure firewall to accept only a particular product version). In one embodiment, the operator is restricted to only be allowed to enter some information such as only entering ticket printer data or only update versions for ticket printers, and/or restricted to only updating, altering, and defining some of the rules for the external devices.

As mentioned, the present invention seeks to eliminate, the possibility of unauthorized control or modification of software used by EGMs, and allow only tested and regulatory approved, electronic devices to communicate with the EGM. A malicious attacker may attack a USB disk drives and/or may attack other types of USB devices are possible. In one embodiment, by way of example only, to mitigate the threat the present invention may white list just the USB disks that a manufacturer of EMG that provides EGM's, which are approved and comply with all gaming commission laws, rules, and/or regulations (e.g., IGT®), delivers (e.g. screen devices by USB reported vendor ID and model ID) and prevent a commodity USB drive being plugged into from someplace else that could contain malicious code. Hence, the present invention employs the device security firewall having defined rules and the inclusion list of devices allowed to operate on a gaming device and the exclusion list of devices not allowed to operate on the gaming device for determining acceptable data traffic on the gaming device.

Turning now to FIG. 1, a block diagram illustrating a gaming system environment 100 is shown. Environment 100 includes a Gaming Terminal Data Repository (GTDR) connected via one or more network interface(s) to a gaming network which, for example, may include gaming devices (e.g., gaming terminals) and/or other devices, in which aspects of the present invention may be realized. As illustrated in FIG. 1, the gaming environment 100 may comprise a gaming system 122 located in a physical environment (not shown). In one embodiment, the physical environment includes at least a portion of a physical structure, such as casino, housing one or more components of the gaming system 122. The gaming system 122 includes one or more gaming system devices 124 or components. The gaming system devices 124 may include gaming machines 125, such as those known as video or slot machines. The devices 124 may also include "table" games 127 such as Blackjack and Roulette. The gaming devices 124 may also include components or devices such as player tracking card readers 129, coin counters and other gaming devices functionality options, which devices or components may be linked or associated with other devices. The devices or components may also comprise computers or servers and communication equipment, cashier and accounting workstations and a wide variety of other elements.

In one embodiment, the gaming system 122 may include a variety of sub-systems. These sub-systems may be partially or fully independent of one another or may be related. In one embodiment, each system may be included or be part of a network. In one embodiment, the gaming system 122 may include a game presentation/operation system, which includes at least one game server 126. The game server 126 may comprise a computing device including a processor and a memory. The game server 126 may be adapted to perform a variety of functions. This functionality may be implemented by software and/or hardware of the server 126. In one embodiment, the game server 126 may be arranged to provide information or instructions to the one or more gaming devices 124 or individual gaming system components. The information may comprise game code and control data. In one embodiment, the game server 126 may also be arranged to accept information from the gaming devices 124 or components. For example, the game sever 126 may accept information regarding the status of operation of a particular gaming system device 124 (such as "normal" or "malfunction").

In one embodiment, the game server 126 is part of a network, which includes a communication link between the game server 126 and selected gaming system device(s) 124 and/or other component(s) with which communication is desired. A communication interface may be associated with the game server 126 and each device or component for facilitating the communication. The communication interfaces may have a variety of architectures and utilize a variety of protocols such as IEEE-1394 (FireWire™) or Ethernet in the case where the communication link is a wired link, or a wireless link utilizing a wireless protocol such as WIFI, Bluetooth™, NFC, Radio Frequency (RF), Infrared, etc. The communication links may transmit electrical, electromagnetic or optical signals, which carry digital data streams, or analog signals representing various types of information. In one embodiment, such as when the gaming device 124 comprises a gaming machine 125, the device 124 may include a master gaming controller, which controls the functions of game operation. The communication interface may be associated with the master gaming controller, permitting data to be transmitted between the game server 126 and the master gaming controller.

In one embodiment, the gaming system 122 may include a player tracking system, which includes at least one player-tracking server 128. The player-tracking server 128 may also comprise a computing device including a processor and a memory. The player-tracking server 128 may be adapted to perform player-tracking functions. For example, the player-tracking server 128 may store information regarding the identities of players and information regarding the game play of those players. This information may include time of play, coin in/coin out or other monetary transaction data, and in an arrangement where players are awarded points based on play, a player's point total. Once again, the player tracking system includes a network comprising a communication link provided between the player tracking server 128 and one or more of the gaming devices 124 having a player tracking function or other components of the gaming system 122 associated with the system. In one embodiment, such as where the gaming device 124 comprises a gaming machine, the device may include a management interface board, which controls a card reader. The management interface board may be arranged to receive data from the master gaming controller of the gaming system device 124. A communication interface is associated with the management interface board, permitting data to be transmitted between the player tracking server 128 and the management interface board.

In the case of table games, a card reader 129 may be associated with the table (e.g., the card reader located on or near the table game). Players may utilize the card reader to identify themselves. Information regarding play of the table game may be input through an input device by a dealer, coin counter or the like, and this information may be transmitted to the player tracking server 128.

In one embodiment, the gaming system 122 may include an accounting system, which includes at least one accounting server 130. The accounting server 130 may comprise a computing device including a processor and a memory. The accounting server 130 is preferably adapted to perform financial related functions, such as track financial transactions such as bets and payouts, and perform reconciliations with monies collected from the gaming system devices 124, such as gaming machines 125, tables games 127. The accounting server 30 may be associated with a wide variety of devices, including individual gaming system devices 124 and other servers. Once again, a communication link may be provided between the accounting server 130 and each device with which communications is desired.

In one embodiment, the gaming system 122 may include a progressive award system, which includes at least one progressive server 132. The progressive sever 132 may comprise a computing device including a processor and a memory. The progressive server 132 may be designed to generate progressive award information. In one arrangement, the progressive server 132 may obtain information regarding amounts bet at specific gaming system devices 124, such as gaming machines 125 or table games 127. Utilizing this information, a progressive jackpot award amount may be generated and updated using a specified protocol. The information may be transmitted to one or more displays 134 associated with participating devices 124. Once again, a communication link is preferably provided between the progressive server 132 and each device with which communications is desired. For example, a link may be provided between the progressive server 132 and accounting server 130 for providing payout information to the accounting server 130.

It will be appreciated that the communications links between the various components may be separate and distinct or may be commonly used. It will also be appreciated that one or more of the functions or applications described above may be consolidated, such as at a common server or host. Further, other components for implementing other functionality may be provided. For example, a variety of computing devices, such as user stations, may be connected to the various systems. Printers and other peripheral devices may also be connected to each network or system. A gaming system 122 may be located at least partially in one or more physical gaming environments, such as a casino, restaurant, and/or convenience store. For example, the casino may include publicly accessible game areas where certain of the gaming system devices 124, such as gaming machines 125 and table games 127 are located, as well as secure areas where the servers and other components are located.

A virtual information host 136 is associated with or comprises a portion of the gaming system 122. In one embodiment, the host 136 comprises a computing device, which includes a processor, memory and a display. The virtual information host 136 may be one or more devices separate from devices performing other functions of the system 122, or may be integrated with existing devices. The virtual information host 136 may be designed and adapted to perform functions relating to acquiring, managing, rendering, generating and/or displaying real-time and/or non real-time casino gaming system or "gaming environment" graphical information and information regarding one or more components of the gaming system or environment. Such functionality may also include the generation of at least one graphical user interface on at least one mobile device (e.g., 131), which is configured or designed to graphically display information (e.g., real-time casino information) relating to selected aspects of casino activity. Also, different graphical user interfaces may be displayed on an external application, such as on an application of a computer, smart phone, and/or on any type of mobile device 131. In one embodiment, bi-directional communication channels 121 are provided for direct, two-way communication between the host 136 and at least one game server 126 and at least one player-tracking server 128, and/or any other device with which communications is desired.

In one embodiment, the host may monitor the monetary activity of the EGM. The host may track any error conditions on the EGM. The host can configure the EGM such as to enable/disable games, download games, configure game parameters (denomination, payback, etc.). For example, in one embodiment, the host may be included in a network, such as a server-based gaming network. For example, a gaming server (e.g., an sbX™ server) may be an example of the host. The gaming server (e.g., the sbX™ server) may be a set of servers running central applications and may attach as the host to EGMs via the gaming network. For example, the host may be the sbX™ server managing and controlling the gaming network (e.g., an sbX™ network). For example, a gaming management solution (e.g., IGT® sbX™ gaming management solution) may be a server-based system to act as a repository for all game content that may be downloaded to EGMs, giving each EGM instant access to the technology within the EGM's environment. The game software, random number generator and game logic are controlled by the EGM. This significantly increases configuration speed so that games may be adapted and seamlessly integrate analytics to the database in minutes. Game titles are accessed from the server using a floor manager (e.g., IGT Floor Manager®), running on the host, and allow operators to reconfigure their gaming floor almost instantly. In one embodiment, a floor manager, running on the host, is a G2S-compliant game-to-system management solution that enables operators to remotely change the game mix on the casino floor. In one embodiment, the floor manager application provides operators with sophisticated and user-friendly visualization tools to analyze terminal (e.g., the EGM) and game performance in real-time. Using Quick Change functionality (QCF), the floor manager, running on the host server(s), enables operators to rapidly locate low performing games, select a new theme from the game library and download the new theme on the EGM in the gaming venue floor within minutes. The software displays a map of the casino floor and highlights EGMs color-coded to indicate performance. Operators can select individual terminals and receive analysis at terminal-, multi-game and single-game level, based on KPIs such as coin-in, actual win and occupancy of game. In one embodiment, the floor manager application is a gateway to a game-to-system library allowing operators to quickly schedule changes or switch between themes. Once selected, the game's configurations can be set including denomination, max bet and even volume and credit limits on the EGM. For example, new gaming industry-leading themes may be added to the game library every month and the floor manager application provides rapid deployment to the gaming floor to ensures an EGM will maintain high performance and continually provide the user with newer and advanced games to add to the users favorite and/or preferred games. In one embodiment, the quick recognition and eradication of low performing games and ability to respond to consumer requests on the floor, empowers a gaming venue to concentrate on player satisfaction and gaming experience.

As illustrated in the example of FIG. 1, gaming system 122 may also include one or more mobile devices 131 configured or designed to communicate, via one or more wireless links 111, with various components of the gaming environment 100 such as, for example: information systems (e.g., virtual information host 136); player tracking systems; accounting systems; employee management systems; location positioning systems (e.g., GPS system 133); game servers; surveillance systems; security systems; communications systems; gaming systems (e.g., gaming machines 125, game table devices 127, other mobile devices 125, etc.); etc.

Figure 2:
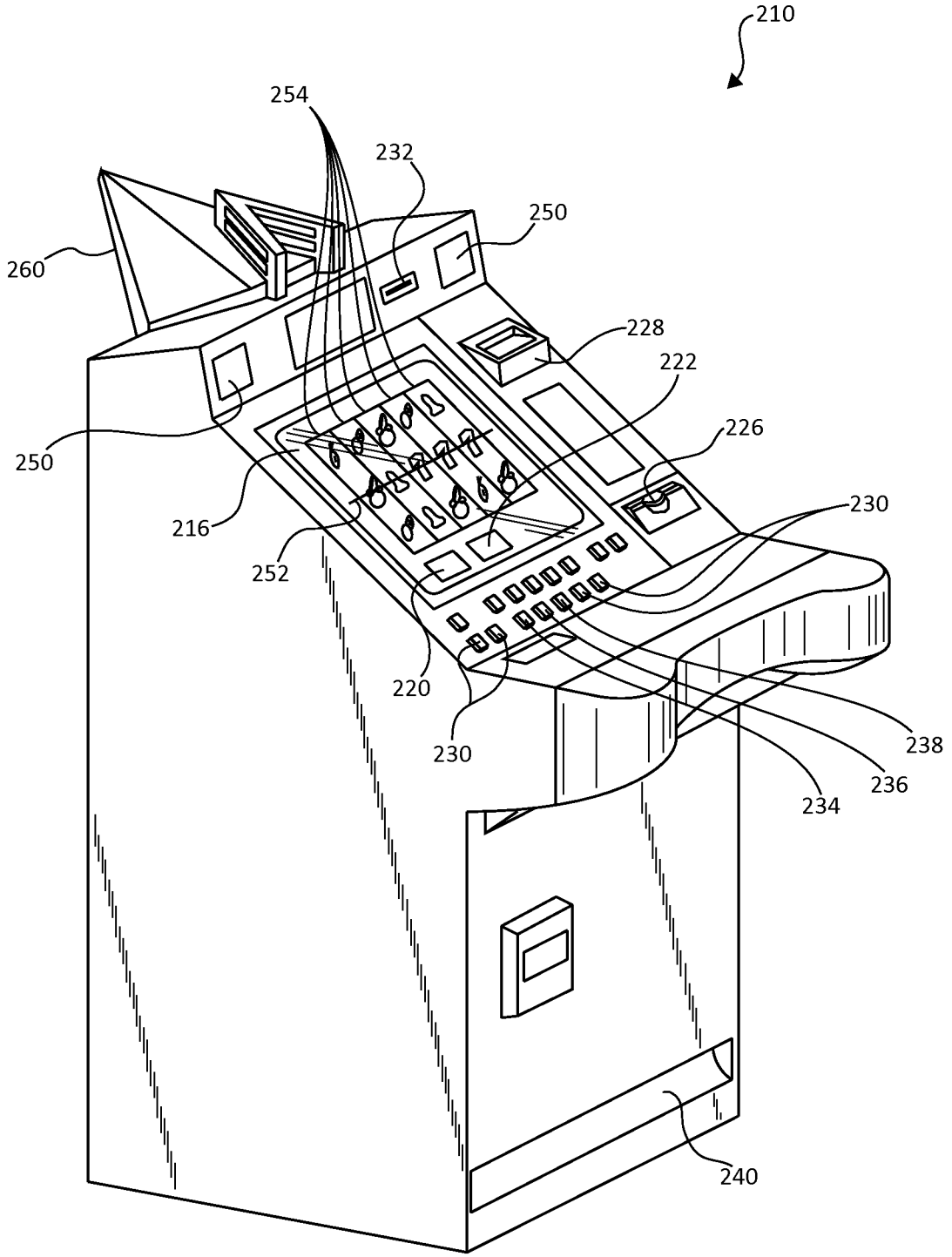
FIG. 2 is a perspective view of one embodiment of a slot machine or gaming device suitable for use in the gaming system of FIG. 1, in which aspects of the present invention may be realized.

FIG. 2 is a perspective view of one embodiment 210 of a slot machine or electronic gaming device suitable for use in the previously depicted system of FIG. 1, in which aspects of the present invention may be realized. FIG. 2 represents a base gaming device 210 that can be employed in the shared display system or the gaming system of the present invention is illustrated as gaming device 210. FIG. 2 illustrates features common to each of the gaming devices. In one embodiment, gaming device 210 has a support structure, housing or cabinet, which provides support for a plurality of displays, inputs, controls and other features of a conventional gaming machine. In the illustrated embodiment, the player plays gaming device 210 while sitting, however, the gaming device is alternatively configured so that a player can operate it while standing or sitting. The illustrated gaming device 210 is positioned on the floor but can be positioned alternatively (i) on a base or stand, (ii) as a pub-style table-top game (e.g., where the participant gaming devices are located remotely from the shared wheel as discussed below), (iii) as a stand-alone gaming device on the floor of a casino with other stand-alone gaming devices, which the player operates while standing or sitting (e.g., where the participant gaming devices are located remotely from the shared wheel as discussed below), or (iv) in any other suitable manner. The gaming device 210 can be constructed with varying cabinet and display configurations. Also, referring to an embodiment for the electronic configuration of gaming device 210, each gaming device may include the components described below in FIG. 3 and FIG. 4.

In one embodiment, each gaming device 210 randomly generates awards and/or other game outcomes based on probability data. That is, each award or other game outcome is associated with a probability and each gaming device generates the award or other game outcome to be provided to the player based on the associated probabilities. Since each gaming device 210 generates outcomes randomly or based upon a probability calculation, there is no certainty that the gaming device 210 will provide the player with any specific award or other game outcome.

In another embodiment, as discussed in more detail below, each gaming device 210 employs a predetermined or finite set or pool of awards, progressive awards, prizes or other game outcomes. As each award or other game outcome is provided to the player, the gaming device 210 removes the provided award or other game outcome from the predetermined set or pool. Once removed from the set or pool, the specific provided award or other game outcome cannot be provided to the player again. The gaming device 210 provides players with all of the available awards or other game outcomes over the course of the play cycle and guarantees a designated amount of actual wins and losses.

Figure 3:
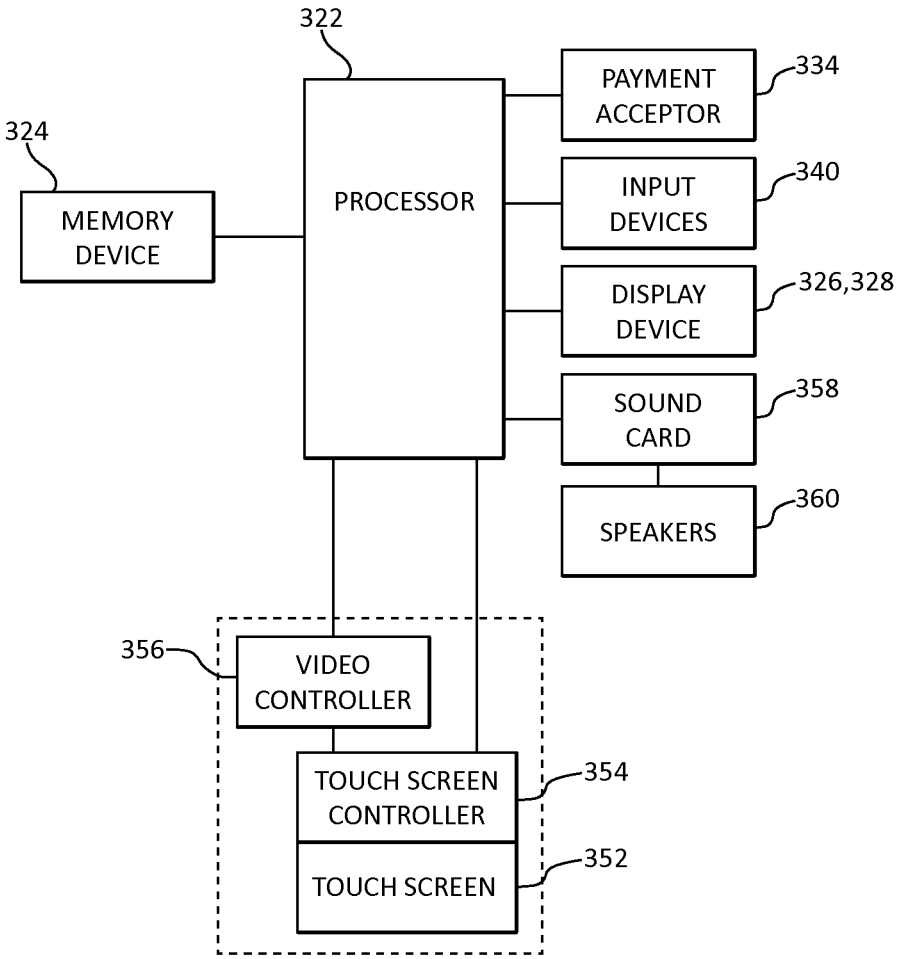
FIG. 3 is a block diagram illustrating an electronic configuration for use in the gaming device of FIG. 2, in which aspects of the present invention may be realized.

As seen in FIG. 2, the gaming device 210 includes a credit display 220 that displays a player's current number of credits, cash, account balance or the equivalent. In one embodiment, gaming device 210 includes a bet display 222 that displays a player's amount wagered. As illustrated in FIG. 3, in one embodiment, each gaming device 210 includes at least one payment acceptor 334 (FIG. 3) that communicates with processor 322 (FIG. 3).

As seen in FIG. 2, the payment acceptor 334 (FIG. 3) in one embodiment includes a coin slot 226, where the player inserts coins or tokens, and a ticket, note or bill acceptor 228, where the player inserts a bar-coded ticket, note, or cash. In one embodiment, a player-tracking card, credit card, debit card or data card reader/validator 232 is also provided for accepting any of those or other types of cards.

In one embodiment, a player inserts an identification card into card reader 232 of gaming device 210. The identification card can be a smart card having a programmed microchip or a magnetic strip coded with a player's identification, credit totals and other relevant information. In one embodiment, money may be transferred to gaming device 10 through an electronic fund transfer and card reader 232 using the player's credit, debit or smart card. When a player funds gaming device 210, processor 322 (FIG. 3) determines the amount of funds entered and the corresponding amount is shown on the credit or other suitable display as described above. In one embodiment, after appropriate funding of gaming device 210, the player presses a play button 234 or pull arm (not illustrated) to start any primary game or sequence of events. In one embodiment, upon appropriate funding, gaming device 210 begins game play automatically. In another embodiment, the player needs to actuate or activate one of the play buttons to initiate play of gaming device 210.

As shown in FIG. 2, a bet one button 236 is provided. The player places a bet by pushing bet one button 236. The player increases the player's wager by one credit each time the player pushes bet one button 236. When the player pushes the bet one button 236, the number of credits shown in the credit display 220 decreases by one, and the number of credits shown in the bet display 222 increases by one. A max bet max button (not shown) can also be provided, which enables the player to bet the maximum wager (e.g., max lines and max wager per line). Gaming device 210 may include other suitable wager buttons 230, such as a max bet button, a repeat bet button, one or more select paylines buttons and one or more select wager per payline buttons.

In one embodiment, a cash out button 238 is provided. The player presses cash out button 238 and cashes out to receive a cash payment or other suitable form of payment corresponding to the number of remaining credits. The player can receive coins or tokens in a coin payout tray 240 or a ticket or credit slip, which are redeemable by a cashier or funded to the player's electronically recordable identification card. Each gaming device 210 also includes one or a plurality of communication ports for enabling communication of a processor with one or more external peripherals, such as external video sources, expansion buses, expansion games or other displays, an SCSI port or a key pad.

In one embodiment of FIG. 2, in combination with in FIG. 3, a touch-screen 352 (FIG. 3) is provided in one embodiment and operates with a touch-screen controller 354, processor 322 (FIG. 3) and display device 326,328 (FIG. 3A). Touch-screen 352 (FIG. 3) and the touch-screen controller 354 are also connected to a video controller 356. The player touches touch-screen 352 at appropriate places to input decisions and signals into processor 322 of gaming device 210. Also, each gaming device 210 may include a sound-generating device controlled by one or more sounds cards 258, which function in conjunction with processor 322 (FIG. 3). In one embodiment, the sound generating device includes at least one speaker 250 or other sound generating hardware and/or software for generating sounds, such as playing music for the primary and/or secondary game or for other modes of the gaming device, such as an attract mode. In one embodiment, each gaming device 210 provides dynamic sounds coupled with attractive multimedia images displayed on display device 216 to provide an audio-visual representation or to otherwise display full-motion video with sound to attract players to gaming device 210. During idle periods, the gaming device 210 displays a sequence of audio and/or visual attraction messages to attract potential players to gaming device 210. The videos in one embodiment are customized to provide information concerning the shared display of the present invention as discussed below.

In one embodiment, gaming device 210 includes a camera in communication with a processor, which is positioned to acquire an image of a player playing gaming device 10 and/or the surrounding area of gaming device 10. In one embodiment, the camera may be configured to selectively acquire still or moving (e.g., video) images and may be configured to acquire the images in either an analog, digital or other suitable format. Display device 216 may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

In one embodiment, as illustrated in FIG. 2, a base or primary game includes a slot game with one or more paylines 252. Paylines 252 may be horizontal, vertical, circular, diagonal, angled or any combination thereof. For a slot game, gaming device 210 displays at least one reel and preferably a plurality of reels 254, such as three to five reels, in either electromechanical form with mechanical rotating reels or in video form with simulated reels and movement thereof. Each reel 254 displays a plurality of indicia such as bells, hearts, fruits, numbers, letters, bars or other images, which preferably correspond to a theme associated with the gaming device. With a slot game, gaming device 10 awards prizes when reels 254 stop spinning and display a winning or paying symbol or combination of symbols on an active payline 252.

In one embodiment, each gaming device 210 includes indicators 260. Indicators 260 reside on the top of each gaming device 10 and point to or indicate one of the awards or outcomes on top of shared display (not shown) when the shared display stops spinning to reveal randomly or otherwise generated results or outcomes. Indicators 260 may illuminate differently at different times or states for the gaming device 210. The illumination of the indicator 260 in one embodiment depends upon whether the gaming device 210 is playing a base game, is in a state in which the player is eligible to play the shared display bonus, is in a state in which the player has committed to play the shared display bonus or is in a state in which the player has declined to play a partieular upcoming shared display bonus, as well as other states discussed below.

FIG. 3 is a block diagram illustrating an electronic configuration for use in the gaming device of FIG. 2, here again in which aspects of the present invention may be realized. In the embodiment illustrated in FIG. 3 the player station may include at least one processor 322, such as a microprocessor, a microcontroller-based platform, a suitable integrated circuit or one or more ASICs. The processor 322 is in communication with or operable to access or to exchange signals with at least one data storage or memory device 324. In one embodiment, the processor 322 and the memory device 324 reside within the cabinet of the player station. The memory device 324 stores program code and instructions, executable by the processor 322, to control the player station. The memory device 324 also stores other data such as image data, event data, player input data, random or pseudo-random number generators, pay-table data or information and applicable game rules that relate to the play of the player station. In one embodiment, the memory device 324 includes random access memory (RAM), which can include non-volatile RAM (NVRAM), magnetic RAM (MRAM), ferroelectric RAM (FeRAM) and other forms as commonly understood in the gaming industry. In one embodiment, the memory device 324 includes read only memory (ROM). In one embodiment, the memory device 324 includes flash memory and/or EEPROM. Any other suitable magnetic, optical and/or semiconductor memory may operate in conjunction with the player station and gaming system disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming system is operable over a wireless network, such as part of a wireless gaming system. In this embodiment, the player station may be a hand held device, a mobile device or any other suitable wireless device that enables a player to play any suitable game at a variety of different locations. It should be appreciated that a player station as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as mentioned above and seen in FIG. 3, one input device is a touch-screen 352 coupled with a touch-screen controller 354, or some other touch-sensitive display overlay to allow for player interaction with the images on the display. The touch-screen and the touch-screen controller are connected to a video controller 356. A player can make decisions and input signals into the player station by touching the touch-screen at the appropriate places. One such input device is a conventional touch-screen button panel. In another embodiment, a plurality or each of the display segments is a touch-screen 352 coupled with a touch-screen controller 354 or some other touch-sensitive display overlay to allow for player interaction with the images on the display segments. The touch-screens 352 and the touch-screen controllers 354 are connected to a video controller. The player station may further include a plurality of communication ports for enabling communication of the processor with external peripherals, such as external video sources, expansion buses, game or other displays, an SCSI port or a key pad. In one embodiment, at least one payment acceptor 324 that communicates with processor 322 for playing a bet, input devices 340, and display devices 326,328 are provided.

The EGMs, the central controller and the display segments may include serial interfaces and/or ethernet (e.g., G2S (game-to-system) protocol uses commodity Ethernet equipment and TCP/IP) to connect to specific subsystems or subnets internal and external to the player stations, central controller and the display segments. The serial devices may have electrical interface requirements that differ from the "standard" EIA serial interfaces provided by general-purpose computers. These interfaces may include EIA, Fiber Optic Serial, optically coupled serial interfaces, and current loop style serial interfaces, etc. In addition, to conserve serial interfaces internally in the player station, serial devices may be connected in a shared, daisy-chain fashion where multiple peripheral devices are connected to a single serial channel.

The serial interfaces and/or ethernet may be used to transmit information using communication protocols that are unique to the gaming industry. For example, SAS is a communication protocol used to transmit information, such as metering information, from a player station to a remote device. Often SAS is used in conjunction with a player tracking system. EGM may be treated as peripheral devices to a casino communication controller and connected in a shared daisy chain fashion to a single serial interface and/or ethernet. In both cases, the peripheral devices are preferably assigned device addresses. If so, the serial controller circuitry must implement a method to generate or detect unique device addresses. In one embodiment, security-monitoring circuits detect intrusion into a player station or gaming station by monitoring security switches attached to access doors in a designated area, such as a player station cabinet. In one embodiment, access violations result in suspension of game play and can trigger additional security operations to preserve the current state of game play. These circuits also function when power is off by use of a battery backup.

In one embodiment, as seen in FIG. 3, the player station includes a sound generating device controlled by one or more sounds cards 358, which function in conjunction with the processor. In one embodiment, the sound generating device includes at least one and preferably a plurality of speakers 360 or other sound generating hardware and/or software for generating sounds, such as playing music for the primary and/or secondary game or for other modes of the player station, such as an attract mode. In one embodiment, the player station provides dynamic sounds coupled with attractive multimedia images displayed on one or more of the display devices to provide an audio-visual representation or to otherwise display full-motion video with sound to attract players to the player station. During idle periods, the player station may display a sequence of audio and/or visual attraction messages to attract potential players to the player station. The videos may also be customized for or to provide any appropriate information.

In one embodiment, the gaming system may include a sensor, such as a camera in communication with the processor (and possibly controlled by the processor) that is selectively positioned to acquire an image of a player actively using the player station and/or the surrounding area of the player station. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia. In another embodiment, the gaming system includes a wireless transceiver or a camcorder and the display segments are components of or are connected to televisions, satellites, DVD players, digital video recorders and Internet-enabled devices. In one embodiment, the game may be displayed on the central display and replicated on one or more the player stations. In another embodiment, the game is only displayed on the central display and the player station is only used to input decisions or commands in the game. In another embodiment, a primary or base game is displayed on the player station and/or the central display and one or more bonus games are displayed on the central display only. In one embodiment, the player stations provide other information to a player, such as the win/loss history of that certain games or the win/loss history of that player. It should be appreciated that the central display and the player stations may work together with a central controller or a plurality of servers to provide the games to the player in any suitable manner.

Figure 4:
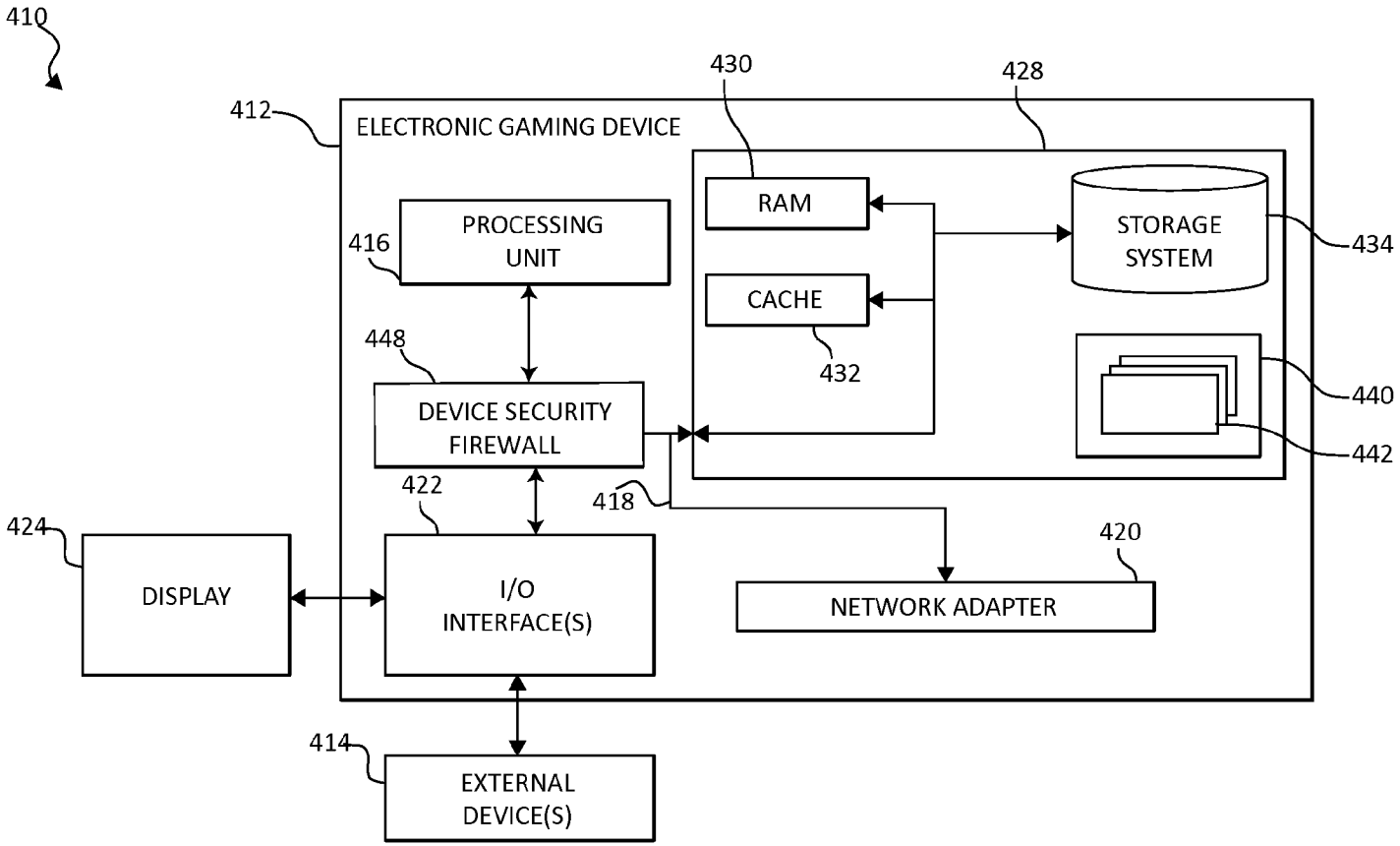
FIG. 4 is a block diagram illustrating a hardware structure of an electronic gaming device computing system in which aspects of the present invention may be realized.

Turning now to FIG. 4, a schematic of an example of a hardware structure of an electronic gaming device computing system is shown. The electronic gaming system 410 is only one example of a hardware structure of an electronic gaming device and is not intended to suggest any limitation as to the scope of use or functionality of embodiments of the invention described herein. Regardless, electronic gaming system 410 is capable of being implemented and/or performing any of the functionality set forth herein above. In electronic gaming system 410, there is a computer system/server 412, which is operational with numerous other general purpose or special purpose computing system environments or configurations. Examples of well-known computing systems, environments, and/or configurations that may be suitable for use with computer system/server 412 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 412 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 412 may be practiced in the electronic gaming system 410 where tasks are performed by remote processing devices that are linked through a communications network. In the electronic gaming system environment, program modules may be located in both local and remote computer system storage media including memory storage devices. As shown in FIG. 4, computer system/server 412 in the electronic gaming system 410 is shown in the form of a general purpose-computing device. The components of computer system/server 412 may include, but are not limited to, one or more processors or processing units 416, a system memory 428, and a bus 418 that couples various system components including system memory 428 to processor 416.

Bus 418 represents one or more of any of several types of bus structures, including a memory bus or memory controller, a peripheral bus, an accelerated graphics port, and a processor or local bus using any of a variety of bus architectures.

Computer system/server 412 typically includes a variety of computer system readable media. Such media may be any available media that is accessible by computer system/server 412, and it includes both volatile and non-volatile media, removable and non-removable media. System memory 428 can include computer system readable media in the form of volatile memory, such as random access memory (RAM) 430 and/or cache memory 432. Computer system/server 412 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "USB disk"), and an optical disk drive for reading from or writing to a removable, non-volatile optical disk such as a CD-ROM, DVD-ROM, or other optical media can be provided. In such instances, each can be connected to bus 18 by one or more data media interfaces. As will be further depicted and described below, memory 428 may include at least one program product having a set (e.g., at least one) of program modules that are configured to carry out the functions of embodiments of the invention.

The embodiments of the invention may be implemented as a computer readable signal medium, which may include a propagated data signal with computer readable program code embodied therein (e.g., in baseband or as part of a carrier wave). Such a propagated signal may take any of a variety of forms including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable medium may be transmitted using any appropriate medium including, but not limited to, wireless, wireline, optical fiber cable, radio-frequency (RF), etc., or any suitable combination of the foregoing.

Program/utility 440, having a set (at least one) of program modules 442, may be stored in memory 428 by way of example, and not limitation, as well as an operating system, one or more application programs, other program modules, and program data. Each of the operating systems, one or more application programs, other program modules, and program data or some combination thereof, may include an implementation of a networking environment. Program modules 442 generally carry out the functions and/or methodologies of embodiments of the invention as described herein.

Electronic gaming device computer system/server 412 may also communicate with one or more external devices 414 such as a keyboard, a USB ticket printer, a USB bill acceptor, a USB touch screen, a pointing device, a display 424, etc.; one or more devices that enable a consumer to interact with computer system/server 412; and/or any devices (e.g., network card, modem, etc.) that enable computer system/server 412 to communicate with one or more other computing devices. Such communication can occur via I/O interfaces 422. Still yet, computer system/server 412 can communicate with one or more networks such as a local area network (LAN), a general wide area network (WAN), and/or a public network (e.g., the Internet) via network adapter 420. As depicted, network adapter 420 communicates with the other components of computer system/server 412 via bus 418. It should be understood that although not shown, other hardware and/or software components could be used in conjunction with computer system/server 412. Examples include, but are not limited to: microcode, device drivers, redundant processing units, external disk drive arrays, RAID systems, tape drives, and data archival storage systems, etc. The electronic gaming device computer system/server 412 also includes the device security firewall 448. In one embodiment, the device security firewall 448 is a software package and sits between the EGM software and the OS.

Figure 5:
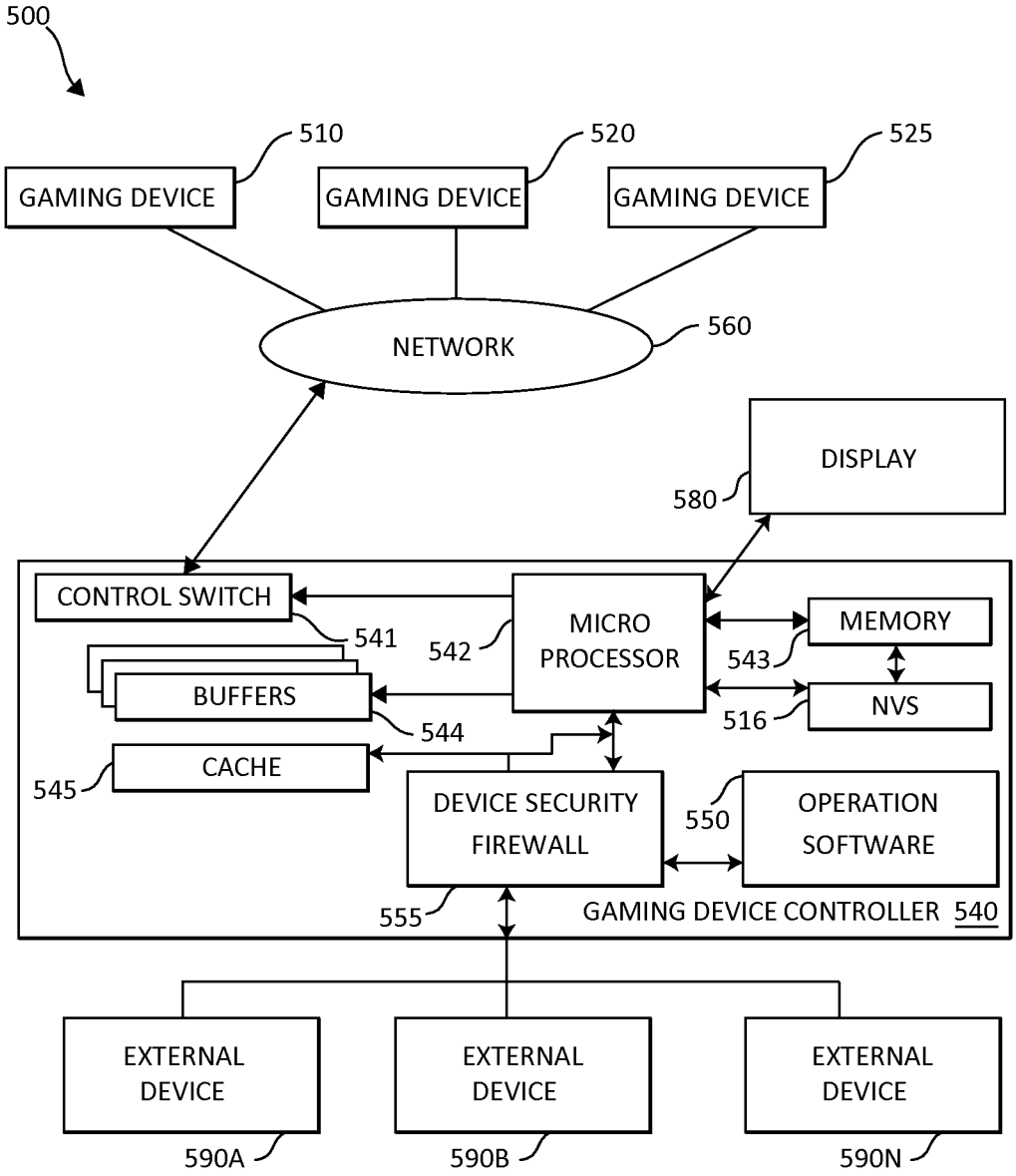
FIG. 5 is a block diagram illustrating a hardware structure of an electronic gaming device computing system in which aspects of the present invention may be realized.

Turning now to FIG. 5, a schematic of an alternative hardware structure of an EGM computing system 500 is shown according to the present invention. Electronic gaming devices (EGM) 510, 520, 525, are shown, each with a central processing unit for performing various gaming functions and data processing as part of an electronic gaming system 500. The EGM, 510, 520, and 525 may be one or more physical devices or logical devices to accomplish the purposes of the present invention in the electronic gaming system 500. A network connection 560 is depicted and may be any I/O interface type, a wireless network, a wired network, a LAN, a WAN, heterogeneous, homogeneous, public (i.e. the Internet), private, or any combination thereof. The electronic gaming devices, 510, 520, and 525 may be local or distributed among one or more locations and may be equipped with wired and wireless Ethernet. Electronic gaming device system 500 is accordingly equipped with a suitable fabric (not shown in FIG. 5) or network adaptor 560 to communicate.

To facilitate a clearer understanding of the methods described herein, gaming device controller 540 is shown in FIG. 5 as a single processing unit, including a microprocessor 542, system memory 543 and nonvolatile storage ("NVS") 516. It is noted that in some embodiments, gaming device controller 540 is comprised of multiple processing units, each with their own processor complex and system memory, and interconnected by a dedicated network within electronic gaming system 500. In one embodiment, system memory 543 includes, is in association with, or is in communication with the operation software 550 for performing methods and operations described herein. As shown in FIG. 5, system memory 543 may also include or be in communication with a cache 545 for storage 530, also referred to herein as a "cache memory", for buffering "write data" and "read data", which respectively refer to write/read requests and their associated data. In one embodiment, cache 545 is allocated to the gaming device controller 540 and to the system memory 543, yet remains accessible by microprocessor 542 and may serve to provide additional security against data loss, in addition to carrying out the operations as described in herein. A display module 580, in communication with the electronic gaming device controller 540 and the microprocessor 542, is provided for accomplishing the purposes of the invention described herein.

In some embodiments, cache 545 is implemented with a volatile memory and non-volatile memory and coupled to microprocessor 542 via a local bus (not shown in FIG. 5) for enhanced performance of electronic gaming system 500. The NVS 516 included in data gaming device controller is accessible by microprocessor 542 and serves to provide additional support for operations and execution of the present invention as described in other figures. The NVS 516, may also referred to as a "persistent" cache, or "cache memory" and is implemented with nonvolatile memory that may or may not utilize external power to retain data stored therein. The NVS may be stored in and with the cache 545 for any purposes suited to accomplish the objectives of the present invention. In some embodiments, a backup power source (not shown in FIG. 5), such as a battery, supplies NVS 516 with sufficient power to retain the data stored therein in case of power loss to electronic gaming system 500. In certain embodiments, the capacity of NVS 516 is less than or equal to the total capacity of cache 545.

The gaming device controller 540 may include a device security firewall 555. The device security firewall 555 may work in conjunction with each and every component of the gaming device controller 540, the electronic gaming devices 510, 520, 525, and storage devices (not shown). The device security firewall 555 may be structurally one complete module or may be associated and/or included with other individual modules. The device security firewall 555 accepts and controls the data traffic for each and every external device 590 (illustrated in FIG. 5 as 590A-N).

The gaming device controller 540 includes a control switch 541 for controlling the EGMs 510, 520, 525, a microprocessor 542 for controlling all the gaming device controller 540, a nonvolatile control memory 543 for storing a microprogram (operation software) 550 for controlling the operation of gaming device controller 540, data for control, cache 545 for temporarily storing (buffering) data, and buffers 544 for assisting the cache 545 to read and write data, a control switch 541 for controlling a protocol to control data transfer to or from the storage devices 530, the device security firewall 555, in which information may be set. Multiple buffers 544 may be implemented with the present invention to assist with the operations as described herein. In one embodiment, the electronic gaming devices, 510, 520, 525 and the gaming device controller 540 are connected through a network adaptor 560 for using wired and wireless Ethernet.

In one embodiment, the host computers or one or more EGMs, 510, 520, 525 and the gaming device controller 540 are connected through a network 560 as an interface for using wired and wireless Ethernet. In one embodiment, the operation of the system shown in FIG. 5 will be described. The microprocessor 542 may control the memory 543 to store command information from the host device (physical or virtual) 510 and information for identifying the host device (physical or virtual) 510. The control switch 541, the buffers 544, the cache 545, the operating software 550, the microprocessor 542, memory 543, NVS 516, device security firewall 555 are in communication with each other and may be separate or one individual component(s). Also, several, if not all of the components, such as the operation software 550 may be included with the memory 543. Each of the components within the electronic gaming system 500 shown may be linked together and may be in communication with each other for purposes suited to the present invention. In one embodiment, one or more of the device security firewall 555 maybe used as needed, based upon the storage architecture and users preferences. In one embodiment, the device security firewall 555 is configured to only accept these external devices as described on the white list, or inclusion list and/or exclusion list. In one embodiment, the device security firewall 555 incorporates the laws, rules, and/or regulations for accepting and controlling the data traffic for external devices listed on the inclusion list. The inclusion list, as mentioned above, maybe stored in the memory 543, the NVS 516, and/or the cache 545 and/or on a persistent storage device such a disk drive (e.g., a hard disk drive "HDD" or solid state drive "SSD").

Figure 6:
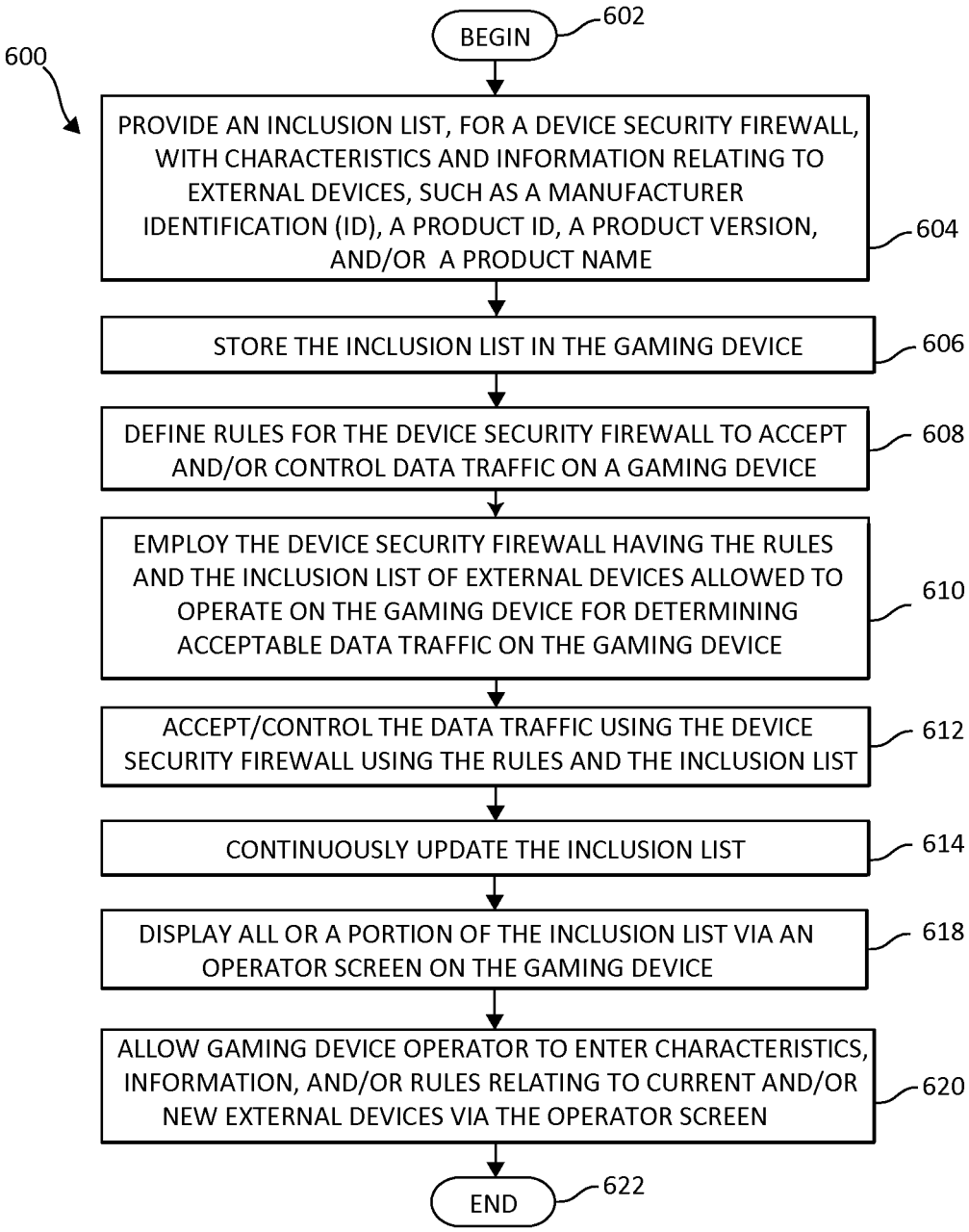
FIG. 6 is a flow chart illustrating an exemplary method for providing device security of an electronic gaming system in which aspects of the present invention may be realized.

FIG. 6 is a flow chart illustrating an exemplary method 600 for providing device security of an electronic gaming system in which aspects of the present invention may be realized. The method 600 begins (step 602) by providing an inclusion list, for a device security firewall, with characteristics and information relating to external devices, such as a manufacturer identification (ID), a product ID, a product version, and/or a product name and the like (step 604). The inclusion list may include a regulatory gaming commission rules list. A device security firewall may also have an exclusion list of devices not allowed to operate on the gaming device for determining acceptable data traffic on the gaming device. This list may be a separate list from the inclusion list and/or may be part of the inclusion list. Also, the inclusion list and the exclusion list are provided with the characteristics and information relating to the external device. The characteristics and information relating to the external device includes a manufacturer Identification (ID), a product ID, a product version, a product name, a interfaces and connection devices (e.g., the USB) which connects the gaming device to the gaming system and/or other gaming devices, and gaming commission rules and regulations. For example, manufacture A of device B may be allowed to connect on USB but prohibited from connection on a serial bus interface, such as Firewire and/or vice versa. It should be noted that the device security firewall may also include port based rules (e.g., port rules), such as regulatory rules regarding which USB ports a USB disk can work in. For example, one such port rule may be only allowing a USB disk to be used when the USB disk is plugged into USB ports behind a locked door. The port rules thereby provide the device security firewall with approved devices and characteristics that may be plugged into the EGM. The port rules may also define a numerical amount of devices that may be plugged into the EGM at any given time and/or the combination of devices that may be plugged into the EGM. For example, a port rule may indicate the type of printer that may be allowed and/or may state that only one printer may be plugged into the EGM. Thus, the EGM will understand what type of device it is and allowed to be plugged into the EGM by the device being defined in the inclusion list and/or exclusion list. The port rules may be defined, changed, and updated in real time based upon gaming commission regulations, manufacturer recommendations, and/or gaming venue preferences.

In one embodiment, the inclusion list and the exclusion list is provided with the characteristics and information that includes at least one of a manufacturer Identification (ID), a product ID, a product version, a product name, various types of interfaces and connection devices, various types of gaming commission rules and regulations, and the port devices allowed to be plugged into and EGM.

The inclusion list (and/or the exclusion list) may be stored in the gaming device, in the device security firewall, and/or on host device in the gaming network and is used by the device security firewall (step 606). The method 600 defines one or more rules for the device security firewall to accept and/or control the data traffic coming from an external device on a gaming device (step 608). The method 600 may employ the device security firewall having the gaining commission rules, regulations, laws, and/or gaming venue rules and regulations, the inclusion list of external devices allowed to operate on the gaming device for determining acceptable data traffic on the gaming device (step 610). In one embodiment, the device security firewall, having the gaming commission rules, regulations, laws, and/or gaming venue rules and regulations, employs the inclusion list of external devices allowed to operate on the gaming device for determining acceptable data raffle on the gaming device and the exclusion list of external devices not allowed to operate on the gaining device for determining acceptable data traffic on the gaming device. The method 600 may accept/control the data traffic using the device security firewall using the defined rules and the inclusion list and/or the exclusion list (step 612). The method 600 will continuously update in real time the inclusion list and/or exclusion list (step 614). In one embodiment, the exclusion list is incorporated into and makes up a portion of the inclusion list. The method 600 may display all or only a portion of the inclusion list/exclusion list via an operator screen on the gaming device (step 616). A gaming device operator is allowed to enter characteristics, information, and/or rules relating to an existing and/or new external device via that operator screen (step 620). The method 600 ends (step 622).

FIG. 7 is a diagram illustrating an inclusion list 700 in which aspects of the present invention may be realized. As illustrated in FIG. 7, the inclusion list 700 is shown with a list of external devices allowed to operate in the EGMs. In one embodiment, the external devices listed on the inclusion list have been tested and are regulatory approved external devices for use in a EGM thereby ensuring the EGM's regulatory approval, overall quality, servicing capabilities and security of the EGM. The inclusion list 700 contains specific information and characteristics about the external devices such as the manufacturer identification (ID), product ID, product version, product name, and the like. Some external devices may have sub-IDs for information that is also described in the white list the device security firewall is configured to only accept these external devices as described on the white list, or inclusion list.

In one embodiment, by way of example only, the first column of the inclusion list 700 shows the entry number (e.g 1 through for listed in numerical order) of four external devices. The second column shows the product name of each external device. The third column lists the manufacturer identification (ID) of the external device. The fourth column of the inclusion list 700 provides the product number and the fifth column lists the version number. For example, the first entry shows the product name "Tickets USA Ticket Printer" as the external device with the manufacturer ID of 0x6217 (Tickets USA), a product ID of 0x1458, and a version number of 1.01a. The second entry shows the product name "MEI Bill Acceptor" as the external device with the manufacturer ID of 0x8823 (MEI), a product ID of 0x6675, and a version number of 2.02. The third entry shows the product name "Sony Touchscreen" as the external device with the manufacturer ID of 0x1155 (Sony), a product ID of 0x7778, and a version number of 1.54. The fourth entry shows the product name "Rainbow eKey" as the external device with the manufacturer ID of 0x9876 (Rainbow), a product ID of 0x7620, and a version number of 1.0. Thus, in one embodiment, the device security firewall defines the rules for accepting only the exact device listed on the inclusion list. For example, the device security firewall may reject Manufacturer 0x6217, product 0x1458, and version 1.01b since it is not explicitly listed. In one embodiment, the device security firewall defines the rules for accepting the data traffic on the gaming devices according to defined ranges of the characteristics and information of the external devices on the inclusion list. Also, the device security firewall may be configured to accept all external devices produced by a specified manufacturer regardless of the version. For example, the device security firewall may be configured to accept all external devices from Manufacturer 0x6217 and the product 0x1458 produced by Manufacturer 0x6217 regardless of the version of the product 0x1458.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

Program code embodied on a computer readable medium may be transmitted using any appropriate medium, including but not limited to wireless, wired, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention have been described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that may direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the above figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts, or combinations of special purpose hardware and computer instructions.

What is claimed is:

1. A method for device security on a gaming device having at least one payment acceptor in a gaming system, the method, under control of one or more computer systems configured with executable instructions, comprising:

employing a device security firewall having a plurality of rules and an inclusion list of a plurality of devices, tested and approved by a regulatory gaming commission, allowed to operate on the gaming device for determining acceptable data traffic on the gaming device, the plurality of rules having at least a plurality of gaming commission rules and regulations, laws, and gaming venue rules and regulations;

employing the device security firewall having the plurality of rules and an exclusion list of a plurality of devices not allowed to operate on the gaming device for determining acceptable data traffic on the gaming device; and providing the inclusion list and the exclusion list with a plurality of characteristics and information, wherein the plurality of characteristics and information includes each one of a manufacturer Identification (ID), a product ID, a product version, a product name, a plurality of interfaces and connection devices, a plurality of port rules, and the plurality of gaming commission rules and regulations.

2. The method of claim 1, further including defining the plurality of rules for accepting the data traffic on the gaming devices according to defined ranges of the plurality of characteristics and a specifically identified one of the plurality of devices.

3. The method of claim 1, further including accepting the data traffic on the gaming devices only if one of the plurality of devices is included on the inclusion list.

4. The method of claim 1, further including continuously updating the inclusion list.

5. The method of claim 1, further including continuously updating the inclusion list with one of an updated product version of the one of plurality of devices, a replacement product of the one of plurality of devices, an alternative one of plurality of devices, an alternative one of plurality of devices, a plurality of vendors and manufactures, and upon switching one of plurality of vendors and manufactures.

6. The method of claim 1, further including displaying one of an entire portion of the inclusion list and a portion of the inclusion list via an operator screen on the gaming device.

7. The method of claim 6, further including allowing a gaming device operator to perform one of:

entering the plurality of characteristics and information for a new one of the one of plurality of devices, updating the plurality of characteristics and information for each existing one of the plurality of devices, and defining the plurality of rules for each one of the plurality of devices.

8. The method of claim 6, further including restricting the gaming device operator to enter on the operator screen on the gaming device only a portion of the plurality of characteristics and information for updating, altering, or defining the portion of the plurality of characteristics and information.

9. The method of claim 6, further including restricting the gaming device operator to defining only a portion the plurality of rules.

10. The method of claim 1, further including storing the inclusion list in persistent storage of the gaming device.

11. The method of claim 10, further including communicating the inclusion list to a plurality of gaming devices via one of a plurality of communication channels in a networking environment.

12. A system for device security on a gaming device having at least one payment acceptor in a gaming system, the system comprising:

at least one processor device operable in the gaming system, wherein the processor device:

employs a device security firewall having a plurality of rules and an inclusion list of a plurality of devices, tested and approved by a regulatory gaming commission, allowed to operate on the gaming device for determining acceptable data traffic on the gaming device, the plurality of rules having at least a plurality of gaming commission rules and regulations, laws, and gaming venue rules and regulations;

employs the device security firewall having the plurality of rules and an exclusion list of a plurality of devices not allowed to operate on the gaming device for determining acceptable data traffic on the gaming device; and provides the inclusion list and the exclusion list with a plurality of characteristics and information, wherein the plurality of characteristics and information includes each one of a manufacturer Identification (ID), a product ID, a product version, a product name, a plurality of interfaces and connection devices, a plurality of port rules, and the plurality of gaming commission rules and regulations.

13. The system of claim 12, wherein the at least one processor device defines the plurality of rules for accepting the data traffic on the gaming devices according to defined ranges of the plurality of characteristics and a specifically identified one of the plurality of devices.

14. The system of claim 12, wherein the at least one processor device accepts the data traffic on the gaming devices only if one of the plurality of devices is included on the inclusion list.

15. The system of claim 12, wherein the at least one processor device continuously updates the inclusion list.

16. The system of claim 15, wherein the at least one processor device continuously updates the inclusion list with one of an updated product version of the one of plurality of devices, a replacement product of the one of plurality of devices, an alternative one of plurality of devices, an alternative one of plurality of devices, a plurality of vendors and manufactures, and upon switching one of plurality of vendors and manufactures.

17. The system of claim 12, wherein the at least one processor device displays one of an entire portion of the inclusion list and a portion of the inclusion list via an operator screen on the gaming device.

18. The system of claim 17, wherein the at least one processor device allows a gaming device operator to perform one of:

entering the plurality of characteristics and information for a new one of the one of plurality of devices, updating the plurality of characteristics and information for each existing one of the plurality of devices, and defining the plurality of rules for each one of the plurality of devices.

19. The system of claim 17, wherein the at least one processor device restricts the gaming device operator to enter on the operator screen on the gaming device only a portion of the plurality of characteristics and information for updating, altering, or defining the portion of the plurality of characteristics and information.

20. The system of claim 17, wherein the at least one processor device restricts the gaming device operator to defining only a portion the plurality of rules.

21. The system of claim 12, wherein the at least one processor device stores the inclusion list in persistent storage of the gaming device.

22. The system of claim 12, wherein the at least one processor device communicates the inclusion list to a plurality of gaming devices via one of a plurality of communication channels in a networking environment.

23. A computer program product device security on a gaming device having at least one payment acceptor in a gaming system using a processor device, the computer program product comprising a computer-readable storage medium having computer-readable program code portions stored therein, the computer-readable program code portions comprising:

a first executable portion that employs a device security firewall having a plurality of rules and an inclusion list of a plurality of devices, tested and approved by a regulatory gaming commission, allowed to operate on the gaming device for determining acceptable data traffic on the gaming device, the plurality of rules having at least a plurality of gaming commission rules and regulations, laws, and gaming venue rules and regulations;

a second executable portion that employs the device security firewall having the plurality of rules and an exclusion list of a plurality of devices not allowed to operate on the gaming device for determining acceptable data traffic on the gaming device; and a third executable portion that provides the inclusion list and the exclusion list with a plurality of characteristics and information, wherein the plurality of characteristics and information includes each one of a manufacturer Identification (ID), a product ID, a product version, a product name, a plurality of interfaces and connection devices, a plurality of port rules, and the plurality of gaming commission rules and regulations.

24. The computer program product of claim 23, further including a fourth executable portion that defines the plurality of rules for accepting the data traffic on the gaming devices according to defined ranges of the plurality of characteristics and a specifically identified one of the plurality of devices.

25. The computer program product of claim 23, further including a fourth executable portion that accepts the data traffic on the gaming devices only if one of the plurality of devices is included on the inclusion list.

26. The computer program product of claim 23, further including a fourth executable portion that continuously updates the inclusion list.

27. The computer program product of claim 26, further including a fifth executable portion that continuously updates the inclusion list with one of an updated product version of the one of plurality of devices, a replacement product of the one of plurality of devices, an alternative one of plurality of devices, an alternative one of plurality of devices, a plurality of vendors and manufactures, and upon switching one of plurality of vendors and manufactures.

28. The computer program product of claim 26, further including a fifth executable portion that displays one of an entire portion of the inclusion list and a portion of the inclusion list via an operator screen on the gaming device.

29. The computer program product of claim 26, further including a fifth executable portion that allows a gaming device operator to perform one of:

entering the plurality of characteristics and information for a new one of the one of plurality of devices, updating the plurality of characteristics and information for each existing one of the plurality of devices, and defining the plurality of rules for each one of the plurality of devices.

30. The computer program product of claim 28, further including a fifth executable portion that restricts the gaming device operator to enter on the operator screen on the gaming device only a portion of the plurality of characteristics and information for updating, altering, or defining the portion of the plurality of characteristics and information.

31. The computer program product of claim 26, further including a fifth executable portion that restricts the gaming device operator to defining only a portion the plurality of rules.

32. The computer program product of claim 23, further including a fourth executable portion that stores the inclusion list in persistent storage of the gaming device.

33. The computer program product of claim 23, further including a fourth executable portion that communicates the inclusion list to a plurality of gaming devices via one of a plurality of communication channels in a networking environment.

* * * * *